United States Patent [19]

Conemac

[11] Patent Number: 5,008,648

[45] Date of Patent: Apr. 16, 1991

[54] ELECTRONIC DOOR WEDGE ALARM

[76] Inventor: Timothy D. Conemac, 9533 Gierson Ave., Chatsworth, Calif. 91311

[21] Appl. No.: 407,502

[22] Filed: Sep. 14, 1989

[51] Int. Cl.[5] ..... G08B 13/08

[52] U.S. Cl. ..... 340/546; 200/61.62; 200/61.93; 292/339

[58] Field of Search ..... 340/546, 545; 200/61.93, 61.62; 292/339, 338, 343

[56] References Cited

U.S. PATENT DOCUMENTS

| | | | |
|---|---|---|---|
| 2,870,281 | 1/1959 | Mitchell | 340/546 |
| 4,442,427 | 4/1984 | Morton | 340/546 |
| 4,540,980 | 9/1985 | Porco | 340/546 |
| 4,607,253 | 8/1986 | Wooten et al. | 340/546 |
| 4,890,092 | 12/1989 | Grimm | 340/546 |

*Primary Examiner*—Glen R. Swann, III

[57] ABSTRACT

A wedge-shaped device for use as an alarm for detecting the unauthorized opening of a hinged, inwardly-opening door may be easily installed at the base of the door to resist forced opening of the door while simultaneously sounding a highly audible alarm signal indicative of an attempt to break in. The device uses a top chassis mounted on a bottom chassis to initiate the alarm whenever the top chassis is forced downwardly onto the bottom chassis, and the alarm will continue to sound until the device is reset. The device maintains its wedge shape even after the top chassis is forced down onto the bottom chassis, thereby effectively preventing the door from opening inwardly until the device is removed from its position at the base of the door.

27 Claims, 2 Drawing Sheets

ELECTRONIC DOOR WEDGE ALARM

BACKGROUND OF THE INVENTION

Field of the Invention

The present invention relates generally to an alarm for detecting the unauthorized opening of a door, and more particularly to an improved lightweight, portable, wireless electronic alarm device which may be easily installed as a wedge at the base of an inwardly-opening door to resist forced opening of the door while simultaneously sounding a highly audible alarm signal indicative of an attempt to break in.

One of the consequences of our increasingly crowded urban society has been the inexorably increasing crime rate, the mere threat of which has driven many people to be security-conscious. Breaking and entering and burglary have become increasingly common occurrences, particularly in the case of residential property. Accordingly, the sale and installation of various security systems such as burglar alarms has become a thriving business as many property owners seek to discourage crime to property through the use of such systems.

There are two basic types of security systems: first, the professionally-installed central security system, which is used in privately-owned houses and luxury apartments, and secondly the owner-installable or portable systems of various types which are each installed, for example, on a single door. The second type of device is particularly used by apartment dwellers, both since the purchase of such systems is more economical, and since they can usually be removed and taken when the owner of the device moves. They also find substantial use in homes of people who do not wish to pay the high price of a central security system.

In most apartments and homes the doors are side-hinged inwardly-opening doors, which open by pulling the opening edge of the door inward and which close by pushing the opening edge of the door outward. A number of the relatively inexpensive, owner-installable security devices have been designed for use with such inwardly-opening hinged doors. Typical of one type of such systems are those shown in U.S. Pat. No. 2,870,281, to Mitchell, in U.S. Pat. No. 4,442,427, to Morton, and in U.S. Pat. No. 4,607,253, to Wooten, et al. These devices act as braces installed with one end under the doorknob and the other end on the floor away from the door. When the door is opened slightly, these devices will inhibit the door from opening and will provide an audible alarm.

Such devices function admirably, but they are relatively large and bulky, since they need to reach from the doorknob to the floor at an angle. Thus, they require an area for storage since they can not just be placed on a table or desk or in a bookcase. In addition, they are not desirable to travelers due to their inconvenient size. Finally, they are an eyesore when installed on a door, typically extending out into the room at an angle from the door.

The other type of device is illustrated by U.S. Pat. No. 4,540,980, to Porco. The Porco device is illustrative of those devices which are placed in front of an inwardly-opening hinged door. When the door is opened, the device will be jarred or tipped over, causing an alarm to be sounded. Other similar devices are designed to be hung from the doorknob, and will react to the door being opened through the use of motion detectors.

This type of device is advantageous in that it is typically small and portable, and is frequently used by travelers. However, unlike the first type of device, the second type of device does not prevent a door from being opened. Rather, it will just alert the user that someone has opened the door. It is thus a warning type device rather than a security-enhancing type of device.

It is accordingly the primary objective of the present invention that it provide a design for an alarm which will fit any hinged inwardly-opening door. It is an objective that the device of the present invention sound an alarm when the door is opened a very small amount, that full opening of the door not be necessary in order to set off the alarm. It is another primary objective that, as the device begins to sound an alarm indicating attempted forced entry, it also blocks further opening of the door to prevent access through the door. The device of the present invention should thus effectively prevent the door from being opened from the outside.

The alarm device of the present invention should work with any hinged, inwardly-opening door. It is also an objective of the alarm device of the present invention that it be both simple and easy to install. No tools may be required in the installation, and installing the device should not result in any damage to the door on which the device is installed. It is a particular disadvantage of highly visible devices that they are not aesthetically pleasing. As a result, highly visible devices will not be desirable to a large number of prospective buyers even though the visibility may have some effect to discourage intruders. Therefore, the alarm device of the present invention should be unobtrusive when installed so as not to effect a disconcerting presence inside the property.

It is also apparent to those skilled in the art that by making the alarm device of the present invention portable as well as easy to install without requiring tools. In addition, of course, it is desirable that the improved alarm device of the present invention be mechanically simple to ensure reliable operation. Therefore, as few moving parts as possible should be utilized, to enhance the reliability of the device. The operation of the device should sound an alarm when a forced entry is attempted.

In addition, the improved alarm device of the present invention should also be of solid state construction, to ensure a long, reliable lifetime as well as energy efficient operation. When the alarm is sounded, it should continue until the device is reset, with the resetting operation being simple yet not obvious upon initial inspection. The alarm of the present invention should also be of inexpensive construction, thereby ensuring the broadest possible appeal in the alarm market. Finally, the improved alarm of the present invention should provide all of the aforesaid advantages and objectives without incurring any substantial relative disadvantage.

SUMMARY OF THE INVENTION

The disadvantages and limitations of the background art discussed above are overcome by the present invention. With this invention, a wedge-shaped alarm device is designed to fit under the bottom edge of a hinged, inwardly-opening door. A hollow wedge-shaped top chassis fits over a wedge-shaped bottom chassis, with the entire device being wedge-shaped with a thin front end and a thick back end. The thick back end of the hollow top chassis is moveably mounted on the thick back end of the bottom chassis to allow the thick back end of the bottom chassis to move in and out of the thick back end of the hollow top chassis. Thus, the thickness of the thick back end of the device may vary when the hollow top chassis moves with respect to the thick back end of the bottom chassis.

The mounting mechanism used is a pair of vertical slots in the sides of the bottom chassis near the thick back end. Bolts extending through apertures in the sides of the hollow top chassis extend into the slots in the bottom chassis. When the bolts slide up and down in the slots in the bottom chassis, the hollow top chassis will move up and down on the bottom chassis. Mounted inside the bottom chassis on the bolts is a slide bracket which will move with the top chassis. Thus, as the thick end of the top chassis moves up and down with respect to the thick end of the bottom chassis, the slide bracket will move up and down inside the bottom chassis.

The slide bracket has a conductive element mounted on the underside thereof. Mounted in the bottom chassis under the conductive element on the slide bracket are a pair of contacts. When the thick back end of the top chassis is in its fully upward position with respect to the thick back end of the bottom chassis, the conductive element under the slide bracket is spaced away from the pair of contacts mounted in the bottom chassis. When the thick back end of the top chassis moves downward with respect to the thick back end of the bottom chassis, the conductive element under the slide bracket will move into contact with the pair of contacts.

A spring element is mounted in compression between the slide bracket and the bottom chassis. The spring element will thus bias both the slide bracket and the thick back end of the top chassis upwardly with respect to the thick back end of the bottom chassis. By pressing the top chassis downwardly, the thick back end of the top chassis and the slide bracket will move downwardly with respect to the thick back end of the bottom chassis.

The bottom chassis contains therein a solid state alarm circuit, a battery to power the circuit, and a buzzer or other audible electronic alarm mechanism. The pair of electrical contacts are connected to the solid state alarm circuit. Thus, when the top chassis is pressed downwardly, the thick back end of the top chassis and the slide bracket will move downwardly with respect to the thick back end of the bottom chassis, bringing the conductive element under the slide bracket into contact with the pair of contacts to trigger the alarm.

A high friction surface is placed on the bottom of the bottom chassis to retain it in position on the surface on which it is placed. The device is to be installed on a door by placing the thin front edge of the device under the edge of the door with the door in the closed position. When the door begins to open, the top chassis will be pressed downwardly with respect to the bottom chassis, bringing the conductive element under the slide bracket into contact with the pair of contacts mounted in the bottom chassis, setting off the alarm.

Once actuated, the alarm will continue even if the thick back end of the top chassis moves upwardly with respect to the thick back end of the bottom chassis, removing the conductive element from contact with the pair of contacts. The alarm device may only be turned off by resetting the device. A small, unobtrusive aperture is located under the bottom chassis, with a reset switch in the bottom chassis being accessible through the small aperture. By inserting a thin object such as the tip of a pen through the small aperture, the reset switch may be pressed to reset the alarm (assuming the conductive element is no longer in contact with the pair of electrical contacts in the bottom chassis).

It will be appreciated that the alarm device will also act as a wedge to prevent the door from being opened. The device thus acts both as a wedge to keep the door from being opened by intruders, and as an alarm to indicate that an intruder is attempting to gain entry. The alarm device is compact and light in weight, and thus it is quite portable.

It may therefore be seen that the present invention teaches an alarm device which will fit any hinged inwardly-opening door. The device of the present invention sounds an alarm when the door is opened a very small amount; full opening of the door is not necessary in order to set off the alarm. When the alarm is sounded, it continues until the device is reset, and the resetting operation is simple yet not obvious upon initial inspection. As the device begins to sound an alarm indicating attempted forced entry, it also effectively blocks further opening of the door to prevent access through the door. The device of the present invention thus effectively prevents the door from being opened from the outside.

The alarm device of the present invention will work with any hinged, inwardly-opening door. In addition, the alarm device of the present invention is both simple and easy to install. No tools are required to install the alarm device, and installing it does not result in any damage to the door. Since it is unobtrusively installed under the edge of a door, it is not a highly visible device and as such is not aesthetically displeasing.

The alarm device is portable as well as easy to install without tools, and is therefore highly desirable for use by travelers in hotel rooms. The improved alarm device of the present invention is mechanically simple to ensure reliable operation, and has an absolute minimum of moving parts, thereby enhancing the reliability of the device. It is of solid state construction, ensuring a long, reliable lifetime as well as energy efficient operation. The alarm of the present invention is also of inexpensive construction, thereby ensuring the broadest possible appeal in the alarm market. Finally, the improved alarm of the present invention provides all of the aforesaid advantages and objectives without incurring any relative disadvantage.

DESCRIPTION OF THE DRAWINGS

These and other advantages of the present invention are best understood with reference to the drawings, in which.

FIG. is a side view of a bottom chassis, showing a slotted aperture in the side of the bottom chassis near the thick end thereof.

DETAILED DESCRIPTION OF THE PREFERRED EMBODIMENT

Figure 1:
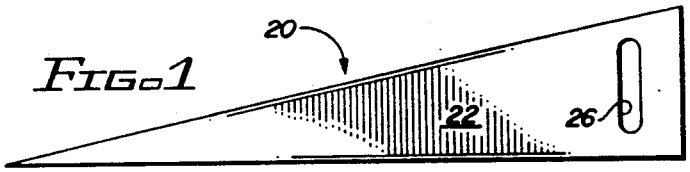
Figure 3:
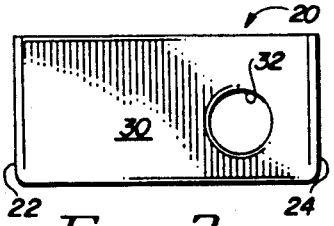
FIG. 3 is a view of the bottom chassis from the thick back end thereof, showing an aperture into which the audio transducer will be mounted.
Figure 2:
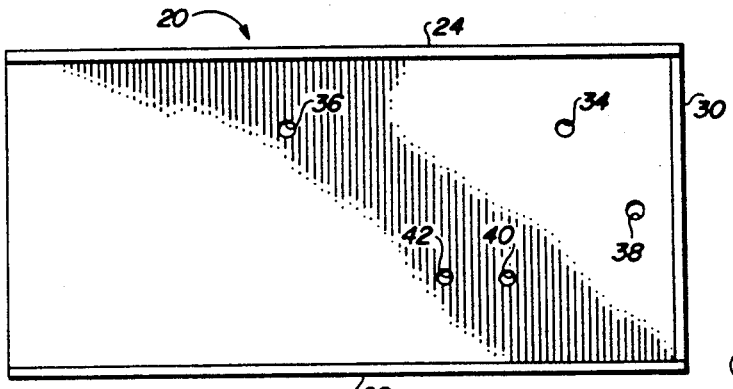
FIG. 2 is a top view of the bottom chassis, showing various apertures in the bottom of the chassis.

The preferred embodiment of the present invention uses two wedge-shaped chassis segments which are mounted together to produce a wedge-shaped device. A bottom chassis 20 is illustrated in FIGS. 1 through 3, and has a thin front end and a thick back end. The bottom chassis 20 has wedge-shaped sides 22 and 24 tapering from a point at the thin front end of the bottom chassis 20 to a thick back edge. A vertical slotted aperture 26 is located in the side 22 near the thick back edge thereof, and an identical vertical slotted aperture (not shown) is located in the side 24 near the thick back edge thereof.

The bottom chassis 20 also has a back side 30 having an aperture 32 therein as best shown in FIG. 3. The bottom of the bottom chassis 20 has a plurality of apertures therein, including a reset aperture 34 which will be used to reset the alarm once it has been triggered. Also located in the bottom of the bottom chassis 20 is an aperture 36 which will be used to mount a circuit board, and an aperture 38 which will be used to mount one end of a spring (not shown). Two other apertures 40 and 42 are mounted in the bottom of the bottom chassis 20 for use in mounting a battery holder (not shown).

Figure 5:
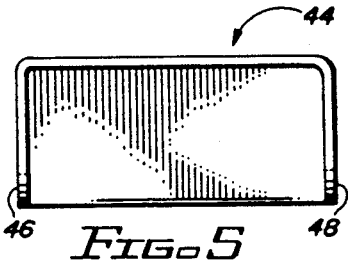
FIG. 5 is a view of the top chassis from the thick back end thereof.
Figure 4:
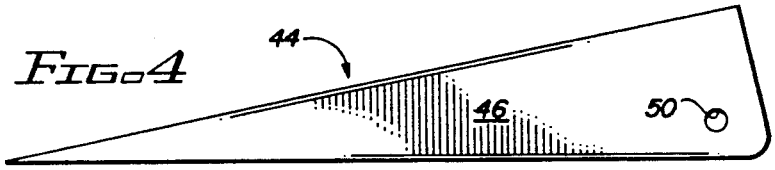
FIG. 4 is a side view of a hollow top chassis, showing the location of an aperture in the side of the top chassis near the thick end thereof.

Referring next to FIGS. 4 and 5, a top chassis 44 is illustrated which also has a thin front end and a thick back end. The top chassis 44 has wedge-shaped sides 46 and 48 tapering from a point at the thin front end of the top chassis 44 to a thick back edge. An aperture 50 is located in the side 46 near the bottom and the thick back edge thereof, and an identical vertical slotted aperture (not shown) is located in the side 48 near the bottom and the thick back edge thereof.

The width of the sides 46 and 48 of the top chassis 44 is sufficient to encompass the sides 22 and 24 of the bottom chassis 20, with a small amount of space between the side 46 of the top chassis 44 and the side 22 of the bottom chassis 20 and a small amount of space between the side 48 of the top chassis 44 and the side 24 of the bottom chassis 20, in addition, the top chassis 44 is slightly longer than the bottom chassis 20 in the preferred embodiment.

Figure 6:
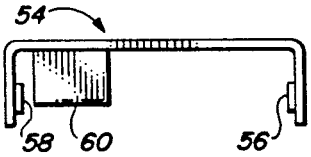
FIG. 6 is a side view of a slide bracket showing a conductive element mounted on the underside of the slide bracket.
Figure 7:
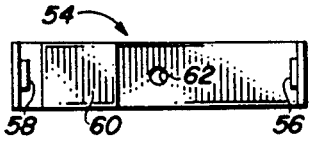
FIG. 7 is a bottom view of the slide bracket shown in FIG. 6.
Figure 8:
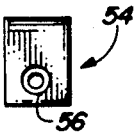
FIG. 8 is an end view of the slide bracket shown in FIGS. 6 and 7.

Referring next to FIGS. 6 through 8, a U-shaped slide bracket 54 is illustrated. The width of the slide bracket 54 is slightly smaller than the width between the sides 22 and 24 of the bottom chassis 20 (FIG. 2). The slide bracket 54 has apertures in the sides (the legs of the U) thereof, with threaded steel inserts 56 and 58 being mounted in each of the apertures.

A conductive element 60 is adhesively mounted on the underside of the slide bracket 54 near one side (one leg of the U) thereof. In the preferred embodiment, the conductive element 60 is a segment of conductive, resilient foam. The slide bracket 54 also has an aperture 62 in the center of the top (the base of the U) thereof which will be used to mount the other end of the spring (not shown).

Figure 9:
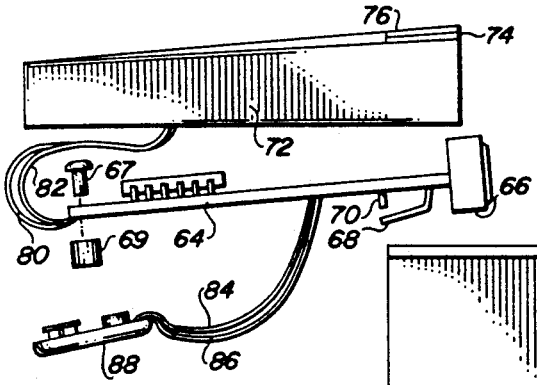
FIG. 9 is a side view of a circuit board having an audio transducer mounted at one end thereof and a reset switch mounted underneath the circuit board, also showing a circuit board cover having a pair of contacts mounted on the top thereof and a battery connector.

Referring next to FIG. 9, a circuit board 64 is illustrated which contains the alarm circuit used by the system of the present invention. The circuit board 64 has an audio transducer 66 mounted at one end thereof. The audio transducer 66 may be a piezoelectric buzzer or other device which produces a high volume alarm when supplied with an electrical input from the circuit board 64, to which it is electrically connected. The audio transducer 66 is circular in configuration, and is designed to fit into the aperture 32 in the back side 30 of the bottom chassis 20 (FIG. 3).

The circuit board 64 will be mounted on the interior of the bottom of the bottom chassis 20 (FIG. 2) using a brass eyelet 67 extending through a nylon spacer 69 and the aperture 36 in the bottom chassis 20, where it may be peened over. Hot melt glue may also be used to secure the components together. Mounted on the bottom of the circuit board 64 is a reset spring contact 68, which is normally biased away from a contact 70, also mounted on the bottom of the circuit board 64.

A cover 72 which is sized to fit over the circuit board 64 and the audio transducer 66 is used to enclose them when the device is assembled. The cover 72 is secured to the bottom of the bottom chassis 20 using hot melt glue. Mounted on the end of the cover 72 which will fit over the audio transducer 66 is a small fiberglass board 74 with two copper contacts 76 and 78 (best shown in FIG. 11) located thereon. The contacts 76 and 78 are connected by wires 80 and 82, respectively, to the circuit board 64. The contacts will be connected when the conductive element 60 (FIG. 6) contacts them to set the alarm off.

When the alarm is sounded, it may be reset by causing the reset spring contact 68 to make electrical contact with the contact 70 (with the conductive element 60 moved away from the two electrical contacts 76 and 78). The reset spring contact 68 is preferably made of beryllium copper or another material having both good conductive and good spring characteristics. This is accomplished through the reset aperture 34 (FIG. 2) located in the bottom of the bottom chassis 20, which reset aperture 34 is aligned with the reset spring contact 56. By inserting a sharp object such as the tip of a pen (not shown) into the reset aperture 34 and pushing the reset spring contact 68 into contact with the contact 70 (again, with the conductive element 60 moved away from the two electrical contacts 76 and 78), the alarm may be reset.

Also connected to the circuit board are power wires 84 and 86 which lead to a battery connector 88. The battery connector 88 is in the preferred embodiment a connector which will be used to attach a 9 Volt battery.

Figure 10:
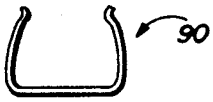
FIG. 10 is a side view of a battery holder.

Referring next to FIG. 10, a battery holder 90 for holding a 9 Volt battery is illustrated. The battery holder 90, together with the components of FIG. 9, are illustrated installed in the bottom chassis 20 in FIG. 11. The battery holder 90 is installed using a pair of rivets 92 and 94 through holes in the battery holder 90 and into the apertures 40 and 42 in the bottom of the bottom chassis 20 (FIG. 2).

Figure 12:
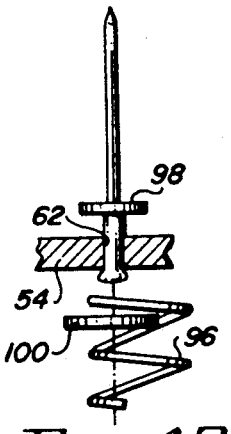
FIG. 12 is an exploded cutaway view showing the installation of one end of a spring to the top chassis.

FIG. 12 illustrates the way a spring 96 can be attached to the slide bracket 54 (FIG. 7) using a pop rivet 98 and a washer 100. The pop rivet 98 is inserted through the aperture 62 in the slide bracket 54 from the top thereof. One end of the spring 96 is placed against the end of the pop rivet 98 where it protrudes through the aperture 62, and the washer 100 is placed over the end of the pop rivet 98. The pop rivet 98 is then riveted, securing the end of the spring 96 between the bottom of the slide bracket 54 and the washer 100. The other end of the spring 96 can be secured to the bottom of the bottom chassis 20 adjacent the aperture 38 (FIG. 2) using an additional pop rivet 98 and washer 100, as shown in FIG. 14.

Figure 13:
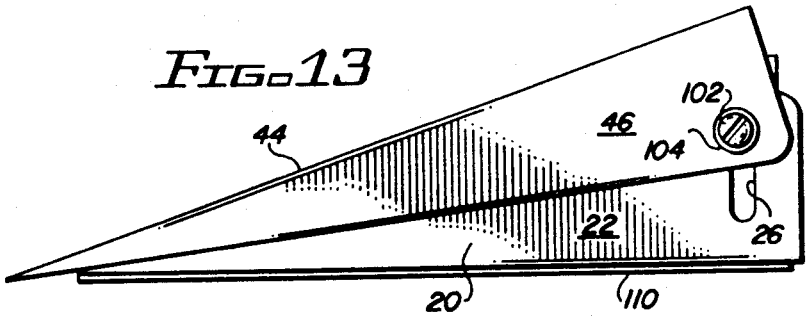
FIG. 13 is a side view of the assembled alarm device of the present invention with the thick back end of the top chassis in its fully upward position with respect to the bottom chassis.
Figure 14:
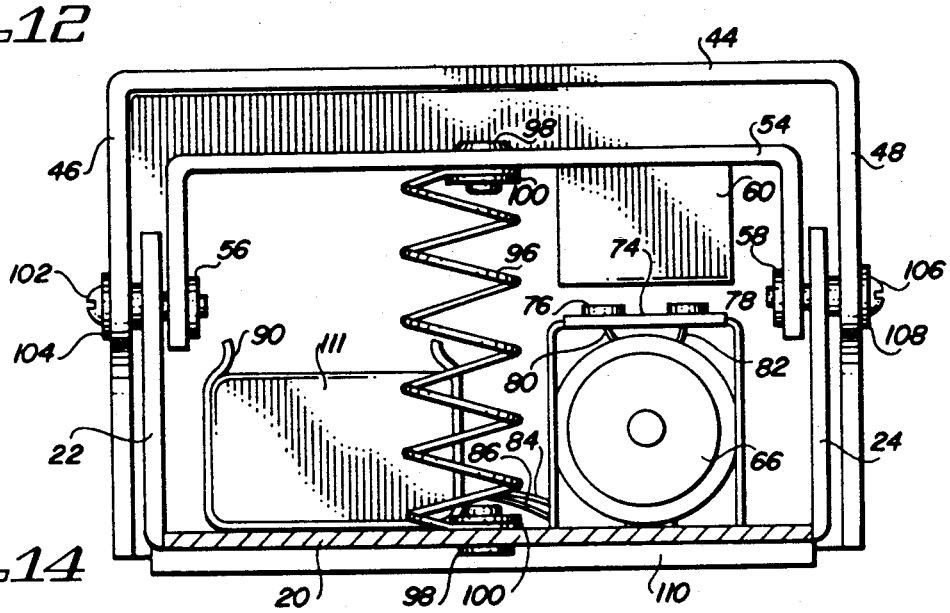
FIG. 14 is an end view of the alarm device shown in FIG. 13 in its fully upward position with respect to the bottom chassis, with the back side of the bottom chassis removed for clarity.

Referring now to FIGS. 13 and 14, the final assembly of the device of the present invention is illustrated. A bolt 102 is inserted through a brass eyelet 104, the aperture 50 in the side 46 of the top chassis 44, the slotted aperture 26 in the side 22 of the bottom chassis 20, and into the steel insert 56 in the slide bracket 54. A bolt 106 is inserted through a brass eyelet 108, the aperture (not shown) in the side 48 of the top chassis 44, the slotted aperture (not shown) in the side 24 of the bottom chassis 20, and into the steel insert 58 on the slide bracket 54.

The brass eyelet 104 extends through the aperture 50 in the side 46 of the top chassis 44 and the slotted aperture 26 in the side 22 of the bottom chassis 20. The brass eyelet 108 extends through the aperture (not shown) in the side 48 of the top chassis 44 and the slotted aperture (not shown) in the side 24 of the bottom chassis 20. The brass eyelets 104 and 108 act as bearings to allow the bottom chassis 20 and the top chassis 44 to move freely with respect to each other.

Figure 11:
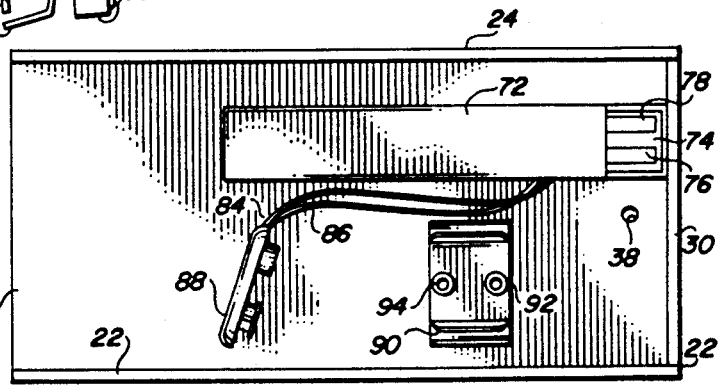
FIG. 11 is a top view of the bottom chassis having the components shown in FIGS. 9 and 10 mounted therein.

Completing the construction of the alarm device is the installation of a non-slip pad 110 onto the bottom of the bottom chassis 20. In the preferred embodiment, the non-slip pad 110 is a sponge rubber pad, which is fastened on to the bottom of the bottom chassis 20 using an adhesive. Also shown in FIG. 14 is a 9 Volt battery 111, which would be connected to the battery connector 88 (FIG. 11).

Figure 15:
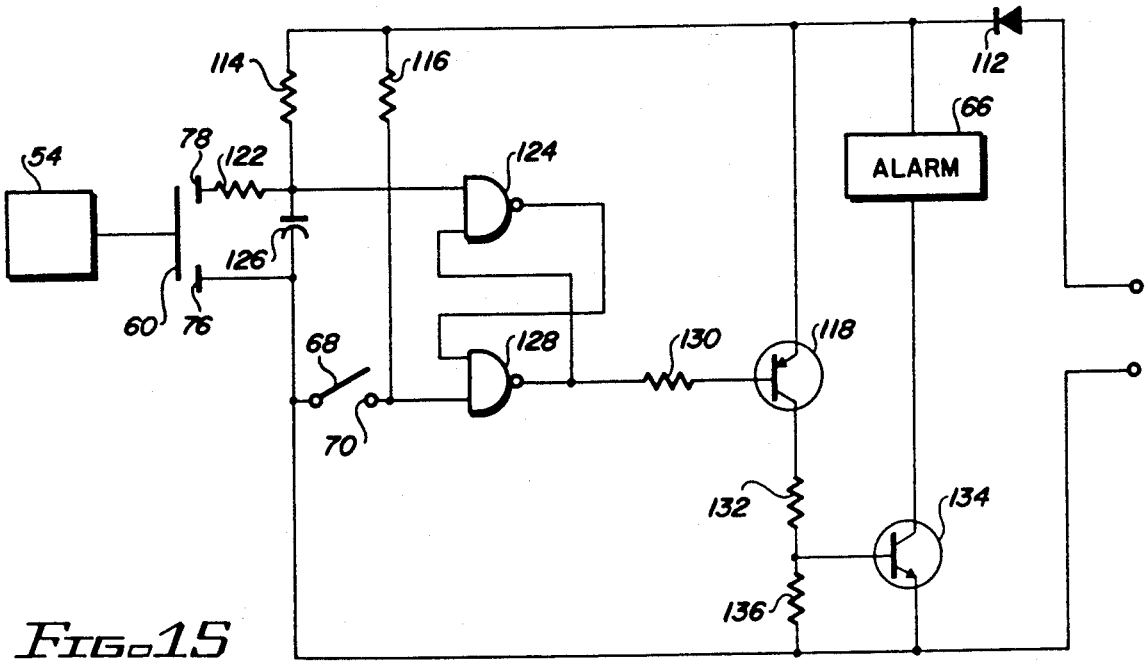
FIG. 15 is a schematic diagram of a circuit which may be used to operate the alarm device of the present invention.

Referring now to FIG. 15, a circuit which may be used as the alarm circuit and implemented on the circuit board 64 is illustrated. A positive power input is supplied to the circuit through a diode 112, the anode of which is connected to the positive power input. The cathode of the diode 112 is connected to one side of a resistor 114, to one side of a resistor 116, to the emitter of a PNP transistor 118, and to one side of the audio transducer 66. The other side of the resistor 114 is connected to one side of a resistor 122, to one input of a two input NAND gate 124, and to one side of a capacitor 126.

The other side of the resistor 122 is connected to the electrical contact 78. The other side of the capacitor 126 is connected to the electrical contact 76, to the reset spring contact 68, and to the negative side of the power supply. The other side of the resistor 116 is connected to one input of a two input NAND gate 128, and to the contact 70. The output of the two input NAND gate 124 is connected as the other input to the two input NAND gate 128. The output of the two input NAND gate 128 is connected as the other input of the two input NAND gate 124, and to one side of a resistor 130.

The other side of the resistor 130 is connected to the base of the PNP transistor 118. The collector of the PNP transistor 118 is connected to one side of a resistor 132. The other side of the resistor 132 is connected to the base of an NPN transistor 134, and to one side of a resistor 136. The other side of the resistor 136 is connected to the negative side of the power supply, as is the emitter of the NPN transistor 134. The collector of the NP transistor 134 is connected to the other side of the audio transducer 66. In the preferred embodiment, the active components are CMOS components to minimize power requirements and to extend battery operating life.

The operation of the circuit shown in FIG. 15 is as described above. When the slide bracket 54 moves the conductive element 60 into contact with the two electrical contacts 76 and 78, the audio transducer 66 will be energized. The preferred technique of using the alarm device of the present invention is described below.

The alarm device is shown in FIGS. 13 and 14 in its ready condition. Note that the conductive element 60 is spaced away from the contacts 76 and 78. The thin front end of the alarm device would be placed under the bottom edge of a hinged, inwardly-opening door (not shown). Preferably, the thin front edge of the device would be placed under the bottom edge of the door near to the opening edge of the door.

When the door begins to open, the top chassis 44 will be forced downwardly onto the bottom chassis 20, which does not move because of the friction of the non-slip pad 110. The thick back end of the top chassis 44 will thus move downwardly with respect to the thick back end of the bottom chassis 20. As the thick back end of the top chassis 44 moves downwardly, the bolts 102 and 104 will move downwardly in the slotted apertures 26 and 28, respectively, bringing down the slide bracket 54. As the slide bracket 54 moves downwardly, the conductive element 60 will come into contact with the contacts and 78, initiating the alarm, which will sound until the device is reset as described above.

The movement of the thick back end of the top chassis 44 downward on the thick back end of the bottom chassis 20 is limited, and the alarm device will retain its wedge configuration even when the thick back end of the top chassis 44 is fully down on the thick back end of the bottom chassis 20. Thus, the alarm device will act as a wedge preventing the door from being opened. As such, the alarm device of the present invention acts as both an alarm and as a bar to forced entry through the door.

It may therefore be appreciated from the above detailed description of the preferred embodiment of the present invention that it teaches an alarm device which will fit any hinged inwardly-opening door. The device of the present invention sounds an alarm when the door is opened a very small amount; full opening of the door is not necessary in order to set off the alarm. When the alarm is sounded, it continues until the device is reset, and the resetting operation is simple yet not obvious upon initial inspection. As the device begins to sound an alarm indicating attempted forced entry, it also effectively blocks further opening of the door to prevent access through the door. The device of the present invention thus effectively prevents the door from being opened from the outside.

The alarm device of the present invention will work with any hinged, inwardly-opening door. In addition, the alarm device of the present invention is both simple and easy to install. No tools are required to install the alarm device, and installing it does not result in any damage to the door. Since it is unobtrusively installed under the edge of a door, it is not a highly visible device and as such is not aesthetically displeasing.

The alarm device is portable as well as easy to install without tools, and is therefore highly desirable for use by travelers in hotel rooms. The improved alarm device of the present invention is mechanically simple to ensure reliable operation, and has an absolute minimum of moving parts, thereby enhancing the reliability of the device. It is of solid state construction, ensuring a long, reliable lifetime as well as energy efficient operation. The alarm of the present invention is also of inexpensive construction, thereby ensuring the broadest possible appeal in the alarm market. Finally, the improved alarm of the present invention provides all of the aforesaid advantages and objectives without incurring any relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An alarm device for use with a hinged, inwardly-opening door, comprising:

a bottom chassis member comprising a first rectangular segment, said bottom chassis member having a front end including a first side of said first rectangular segment and a back end including a second side of said first rectangular segment, said second side of said first rectangular segment being opposite said first side of said first rectangular segment;

a top chassis member comprising a second rectangular segment, said top chassis member having a front end including a first side of said second rectangular segment and a back end including a second side of said second rectangular segment, said second side of said second rectangular segment being opposite said first side of said second rectangular segment;

means for mounting said top chassis member on said bottom chassis member to form a wedge-shaped assembly with the thin edge of said wedge-shaped assembly defined by said first sides of said first and second rectangular segments and the thick edge of said wedge-shaped assembly being defined by said second sides of said first and second rectangular segments, said second sides of said rectangular segments being relatively moveable toward and away from each other;

means for biasing said second sides of said first and second rectangular segments away from each other;

switch means for triggering said alarm device when said second ends of said first and second rectangular segments move toward each other;

an audio transducer; and an alarm circuit electrically connected to said switch means and to said audio transducer, said alarm circuit causing said audio transducer to emit an alarm signal whenever said switch means operates to trigger said alarm device.

2. An alarm device as defined in claim 1, wherein said bottom chassis member additionally comprises:

first and second wedge-shaped side members each having a thin end and a thick end, said first and second side members being mounted on the sides of said first rectangular segment between said first and second sides thereof, said thin ends of said first and second wedge-shaped side members being located adjacent said first side of said first rectangular member and said thick ends of said first and second wedge-shaped side members being located adjacent said second side of said first rectangular member, said first and second wedge-shaped side members extending upward from said first rectangular member; and wherein said top chassis member additionally comprises:

third and fourth wedge-shaped side members each having a thin end and a thick end, said third and fourth side members being mounted on the sides of said second rectangular segment between said first and second sides thereof, said thin ends of said third and fourth wedge-shaped side members being located adjacent said first side of said second rectangular member and said thick ends of said third and fourth wedge-shaped side members being located adjacent said second side of said second rectangular member, said third and fourth wedge-shaped side members extending downward from said second rectangular member.

3. An alarm device as defined in claim 2, wherein said first rectangular member is narrower than said second rectangular member, said third wedge-shaped side member partially overlapping said first wedge-shaped side member and said fourth wedge-shaped side member partially overlapping said second wedge-shaped side member.

4. An alarm device as defined in claim 3, wherein said mounting means comprises:

a first vertically oriented slotted aperture in said first wedge-shaped side member near the thick end thereof;

a second vertically oriented slotted aperture in said second wedge-shaped side member near the thick end thereof;

a first aperture in said third wedge-shaped side member near the bottom and the thick end thereof;

a second aperture in said fourth wedge-shaped side member near the bottom and the thick end thereof;

a first bolt extending through said first aperture in said third wedge-shaped side member and said first slotted aperture in said first wedge-shaped side member; and a second bolt extending through said second aperture in said fourth wedge-shaped side member and said second slotted aperture in said second wedge-shaped side member.

5. An alarm device as defined in claim 4, wherein said mounting means additionally comprises:

a slide bracket located between said first and second wedge-shaped side members, said slide bracket having a first side and a second side, said first bolt being attached to said first side of said slide bracket and said second bolt being attached to said second side of said slide bracket, said slide bracket thus moving with said second rectangular segment of said top chassis member as said second end of said second rectangular segment moves with respect to said second end of said first rectangular segment.

6. An alarm device as defined in claim 5, wherein said biasing means comprises:

a spring mounted at one end thereof to said slide bracket and at the other end thereof to said first rectangular member near said second end thereof.

7. An alarm device as defined in claim 5, wherein said switch means comprises:

a first switch member mounted in said bottom chassis member; and a second switch member mounted under said slide bracket.

8. An alarm device as defined in claim 7, wherein said first switch member comprises:

a first contact; and a second contact, said alarm being triggered when said first and second contacts are electrically connected.

9. An alarm device as defined in claim 8, wherein said second switch member comprises:

a conductive element for contacting said first and second contacts when said second side of said second rectangular member is moved toward said second side of said first rectangular member.

10. An alarm device as defined in claim 9, wherein said conductive element comprises:

a segment of conductive, resilient foam.

11. An alarm device as defined in claim 5, wherein said slide bracket is U-shaped with the U being inverted as said slide bracket is mounted with the base of the U directed toward said second side of said second rectangular segment.

12. An alarm device as defined in claim 1, additionally comprising:

means for causing said alarm circuit to keep said alarm signal sounding once initiated even if said switch returns to said open position.

13. An alarm device as defined in claim 12, additionally comprising:

a reset switch electrically connected to said alarm circuit for causing said alarm circuit to make said alarm signal cease and to reset said alarm device, provided said switch is returned to said open position prior to activating said reset switch.

14. An alarm device as defined in claim 13, wherein said reset switch comprises:

a third electrical contact mounted in said bottom chassis member;

a reset spring contact which is normally biased away from said third electrical contact, said reset spring contact also being located in said bottom chassis member; and an aperture in said first rectangular segment allowing a sharp object inserted into said aperture to contact said reset spring contact and to drive said reset spring contact into electrical contact with said third electrical contact.

15. An alarm device as defined in claim 14, wherein said reset spring contact is made of beryllium copper.

16. An alarm device as defined in claim 1, additionally comprising:

a non-slip pad mounted on the bottom of said first rectangular segment.

17. An alarm device as defined in claim 16, wherein said non-slip pad is made of sponge rubber.

18. An alarm device as defined in claim 1, wherein said alarm circuit utilizes at least two NAND gates to implement its function.

19. An alarm device as defined in claim 1, wherein said alarm circuit uses CMOS components to reduce power required to operate said alarm circuit, thereby extending the operating life of batteries used to power said alarm circuit.

20. An alarm device for use with a hinged, inwardly-opening door, comprising:

a bottom chassis member comprising a first rectangular segment, said bottom chassis member having a front end including a first side of said first rectangular segment and a back end including a second side of said first rectangular segment, said second side of said first rectangular segment being opposite said first side of said first rectangular segment, said bottom chassis member also comprising first and second wedge-shaped side members each having a thin end and a thick end, said first and second side members being mounted on the sides of said first rectangular segment between said first and second sides thereof, said thin ends of said first and second wedge-shaped side members being located adjacent said first side of said first rectangular member and said thick ends of said first and second wedge-shaped side members being located adjacent said second side of said first rectangular member, said first and second wedge-shaped side members extending upward from said first rectangular member;

a non-slip pad mounted on the bottom of said first rectangular segment;

a top chassis member comprising a second rectangular segment, said top chassis member having a front end including a first side of said second rectangular segment and a back end including a second side of said second rectangular segment, said second side of said second rectangular segment being opposite said first side of said second rectangular segment, said top chassis member also comprising third and fourth wedge-shaped side members each having a thin end and a thick end, said third and fourth side members being mounted on the sides of said second rectangular segment between said first and second sides thereof, said thin ends of said third and fourth wedge-shaped side members being located adjacent said first side of said second rectangular member and said thick ends of said third and fourth wedge-shaped side members being located adjacent said second side of said second rectangular member, said third and fourth wedge-shaped side members extending downward from said second rectangular member, said first rectangular member being narrower than said second rectangular member, said third wedge-shaped side member partially overlapping said first wedge-shaped side member and said fourth wedge-shaped side member partially overlapping said second wedge-shaped side member;

means for mounting said top chassis member on said bottom chassis member to form a wedge-shaped assembly with the thin edge of said wedge-shaped assembly defined by said first sides of said first and second rectangular segments and the thick edge of said wedge-shaped assembly being defined by said second sides of said first and second rectangular segments, said second sides of said rectangular segments being relatively moveable toward and away from each other;

means for biasing said second sides of said first and second rectangular segments away from each other;

switch means for triggering said alarm device when said second ends of said first and second rectangular segments move toward each other;

an audio transducer; and an alarm circuit electrically connected to said switch means and to said audio transducer, said alarm circuit causing said audio transducer to emit an alarm signal whenever said switch means operates to trigger said alarm device.

21. An alarm device for use with a hinged, inwardly-opening door, comprising:

a bottom chassis member comprising a first rectangular segment, said first rectangular segment having a first side and a second side, said second side of said first rectangular segment being opposite said first side of said first rectangular segment;

a top chassis member comprising a second rectangular segment, said second rectangular segment member having a first side and a second side, said second side of said second rectangular segment being opposite said first side of said second rectangular segment;

means for mounting said top chassis member on said bottom chassis member to form a wedge-shaped assembly with the thin edge of said wedge-shaped assembly defined by said first sides of said first and second rectangular segments and the thick edge of said wedge-shaped assembly being defined by said second sides of said first and second rectangular segments, said second sides of said rectangular segments being relatively moveable toward and away from each other;

means for biasing said second sides of said first and second rectangular segments away from each other;

switch means for triggering said alarm device when said second ends of said first and second rectangular segments move toward each other;

an audio transducer; and an alarm circuit electrically connected to said switch means and to said audio transducer, said alarm circuit causing said audio transducer to emit an alarm signal whenever said switch means operates to trigger said alarm device.

22. An alarm device for use with a hinged, inwardly-opening door, comprising:

a wedge-shaped bottom chassis member having two opposed wedge-shaped sides, said bottom chassis member having a thin front end and a thick back end, said bottom chassis member being hollow and open on the top thereof;

a wedge-shaped top chassis member having two opposed wedge-shaped sides, said bottom chassis member having a thin front end and a thick back end, said top chassis member being hollow and open on the bottom thereof, said top chassis member being mounted on top of said bottom chassis member with said thick back end of said top chassis member being moveable toward and away from said thick back end of said bottom chassis member;

means for urging said thick end of said top chassis member away from said thick end of said bottom chassis member;

electrical switch means for triggering said alarm device, said electrical switch means having an open position and a closed position, said electrical switch means being driven from said open position to said closed position when said thick back end of said top chassis member is driven toward said thick back end of said bottom chassis member;

an audio transducer located in said bottom chassis member; and an alarm circuit located in said bottom chassis member, said alarm circuit being electrically connected to said electrical switch and said audio transducer, said alarm circuit causing said audio transducer to emit an alarm signal whenever said electrical switch means has been driven to said closed position.

23. An alarm device for use with a hinged, inwardly-opening door, comprising, (a) a bottom chassis member having a front end and a rear end, (b) a top chassis member having a front end and a rear end, (c) hinge means interconnecting the front end of said top chassis member to the front end of said bottom chassis member, (d) means for biasing the rear end of said bottom chassis member from the rear end of said top chassis member, (e) an alarm assembly connected to said bottom chassis member, including a switch connected to said top chassis member and an audio transducer connected to said switch, (f) whereby movement of said rear end of said top chassis member towards said bottom chassis member moves said switch to activate said audio transducer.

24. The alarm device of claim 23 wherein said alarm assembly includes an electrical power source, and wherein said switch and transducer are electrical.

25. The alarm device of claim 24 wherein holding circuit means are provided to keep the alarm actuated once it has been actuated even through the top chassis member is moved back to its at-rest position.

26. The alarm device of claim 25 including a reset switch to deactivate said transducer after actuation thereof.

27. The alarm device of claim 25 including slip-prevention means mounted on the underside of said bottom chassis member.

* * * * *